US008108967B2

(12) United States Patent
Wood

(10) Patent No.: US 8,108,967 B2
(45) Date of Patent: Feb. 7, 2012

(54) HANDLE ASSEMBLY FOR A CLEANING APPLIANCE

(75) Inventor: Ralph Michael Wood, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 157 days.

(21) Appl. No.: 12/185,635

(22) Filed: Aug. 4, 2008

(65) Prior Publication Data

US 2009/0038112 A1 Feb. 12, 2009

(30) Foreign Application Priority Data

Aug. 9, 2007 (GB) ..... 0715564

(51) Int. Cl.
*A47L 9/00* (2006.01)

(52) U.S. Cl. ..... 15/410; 15/335; 15/328

(58) Field of Classification Search ..... 15/410, 15/335, 331, 334, 351, 328
See application file for complete search history.

(56) References Cited

U.S. PATENT DOCUMENTS

| | | | | |
|---|---|---|---|---|
| 2,660,457 | A | 11/1953 | Adelaide H. Mallon | |
| 4,519,113 | A | 5/1985 | Hipple | |
| 4,989,295 | A * | 2/1991 | Guhne et al. | 15/410 |
| 7,891,050 | B2 * | 2/2011 | Liddell | 15/410 |
| 2008/0244860 | A1 * | 10/2008 | Gammack et al. | 15/410 |
| 2009/0038111 | A1 * | 2/2009 | White et al. | 15/410 |

FOREIGN PATENT DOCUMENTS

| | | |
|---|---|---|
| CA | 2374892 | 9/2002 |
| EP | 1265519 | 12/2002 |
| GB | 2416296 | 1/2006 |
| JP | 2005-143724 | 6/2005 |
| JP | 2007-185222 | 7/2007 |
| WO | WO-2006/008444 | 1/2006 |

OTHER PUBLICATIONS

International Search report and written opinion mailed on Nov. 5, 2008 directed at counterpart international application PCT/GB2008/0002512; 9 pages.
GB Search Report dated Oct. 19, 2007 directed towards counterpart foreign application No. 0715564.1.

* cited by examiner

*Primary Examiner* — Dung Van Nguyen
(74) *Attorney, Agent, or Firm* — Morrison & Foerster LLP

(57) ABSTRACT

A handle assembly for a cleaning appliance includes a slidably extendible wand and a connecting portion that includes a first locking arrangement releasably securing the handle assembly to the main body of the cleaning appliance, a second locking arrangement releasably locking the wand in a predetermined position with respect to the connecting portion and an actuator. The actuator is adapted and arranged to move the first and second locking arrangements between locked and unlocked positions. The first locking arrangement is movable independently of the actuator. This arrangement allows a single actuator to be operated by a user to unlock both the first and second locking arrangements simultaneously. However, because the first locking arrangement can move independently of the second locking arrangement, it is possible to secure the handle assembly to the main body of the cleaning appliance while keeping the wand in a locked position.

17 Claims, 5 Drawing Sheets

HANDLE ASSEMBLY FOR A CLEANING APPLIANCE

REFERENCE TO RELATED APPLICATIONS

This application claims the priority of United Kingdom Application No. 0715564.1, filed Aug. 9, 2007, the contents which are incorporated herein by reference.

FIELD OF THE INVENTION

The present invention relates to a handle assembly for a cleaning appliance. Particularly, but not exclusively, the present invention relates to a handle assembly for a vacuum cleaner.

BACKGROUND OF THE INVENTION

Upright vacuum cleaners are well known. Further, upright vacuum cleaners that can be converted from a floor cleaning mode into an "above-the-floor" cleaning mode are also well known. In order to carry out both of these cleaning modes, it is common for an upright vacuum cleaner to incorporate a handle assembly having a wand and hose arrangement which can be used when required for above-the-floor cleaning. In some prior art arrangements, such as that shown in U.S. Pat. No. 4,519,113, the wand and hose assembly attach to the cleaner head such that they form part of the airflow path within the vacuum cleaner when the machine is used in the floor cleaning mode. The wand is then releasable from the cleaner head when above-the-floor cleaning is required. Whilst this is a relatively simple arrangement, the incoming air has to travel through the wand and hose when the machine is used in the floor cleaning mode. Therefore, this arrangement unnecessarily increases losses within the vacuum cleaner.

An alternative arrangement is shown in U.S. Pat. No. 2,660,457. In this arrangement, a wand which forms part of a handle assembly of the vacuum cleaner shown therein is removable from the remainder of the vacuum cleaner. The wand can be reattached to a hose located at the front of the vacuum cleaner for above-the-floor cleaning purposes.

Another known type of handle assembly forming part of a vacuum cleaner is shown in EP 1 265 519. In this arrangement, a handle portion and the wand are releasably attached to a main body of the vacuum cleaner by a catch. The handle portion and wand can be released from the upper end of the hose, turned around and reconnected. In this way, when the handle assembly is to be used for above-the-floor cleaning, the hose is attached to the handle portion with the wand then projecting away from the hose. This arrangement includes a changeover valve which selectively directs incoming air either through the cleaner head or through the hose. Therefore, when the vacuum cleaner is used for above-the-floor cleaning, no air is drawn through the cleaner head.

A further variation of handle assembly is shown in WO 2006/008444. In this arrangement, the illustrated vacuum cleaner has a handle assembly comprising a tubular wand which is slideable between a stowed and an extended position. A single locking mechanism is provided which is able to secure the handle assembly to the remainder of the vacuum cleaner, to lock the tubular wand in the extended position and to release the tubular wand from the extended position. However, this particular locking mechanism requires space on either side of the tubular wand in order to operate. Therefore, this arrangement is not as well suited to small products where space is at a premium.

SUMMARY OF THE INVENTION

It is an object of the invention to provide an improved handle assembly for a vacuum cleaner which improves upon the prior art arrangements. It is a further object of the invention to provide an improved handle assembly for a vacuum cleaner which is more compact than prior art arrangements.

According to the invention, there is provided a handle assembly for a cleaning appliance, comprising, a slideably extendible wand and a connecting portion, connecting portion comprising a first locking arrangement for releasably securing the handle assembly to a main body of the cleaning appliance, a second locking arrangement for releasably locking the wand in a pre-determined position with respect to the connecting portion and an actuator, the actuator being adapted and arranged to move the first and second locking arrangements between locked and unlocked positions, wherein the first locking arrangement is also movable independently of the actuator.

By providing such an arrangement, a single actuator can be operated by a user to unlock both first and second locking arrangements simultaneously. This is convenient for a user because only a single button is required; for example, to release the handle arrangement from the main body or to unlock the wand from a fixed position. However, because the first locking arrangement can move independently of the second locking arrangement, it is possible to secure the handle assembly to the main body of the cleaning appliance whilst keeping the wand in a locked position. This is beneficial when the user wishes to return the cleaning appliance to a floor cleaning mode without collapsing the wand.

Preferably, the first locking arrangement is movable independently of the actuator by engagement with the main body of the cleaning appliance. By providing such an arrangement, when the handle assembly is reattached to the main body of the cleaning appliance, the first locking arrangement is able to be displaced into the unlocked position by a part of the main body of the cleaning appliance so that it can then move back into the locked position to secure the handle assembly to the main body of the cleaning appliance. There is no need for the actuator to have additional travel to provide two locking states, nor are two separate catches with two separate actuators required. Therefore, this arrangement enables the locking arrangements to be more compact than conventional arrangements.

Preferably, the wand is slideable between retracted and extended positions with respect to the connecting portion. More preferably, the pre-determined position is the extended position. By locking the wand in the extended position, the wand can be used for above-the-floor cleaning with no risk of the wand collapsing unexpectedly.

Preferably, the handle is attached to one end of the tubular wand and is movable with respect to the connecting portion. This arrangement allows the wand to be used for above-the-floor cleaning and also as an extendible handle for when the cleaning appliance is used in the floor cleaning mode. By providing an extendible wand incorporating a handle, the wand and handle can be collapsed for storage, reducing the size of the machine for storage or transportation purposes.

BRIEF DESCRIPTION OF THE DRAWINGS

An embodiment of the invention will now be described with reference to the accompanying drawings, in which.

DETAILED DESCRIPTION OF THE INVENTION

Figure 1:
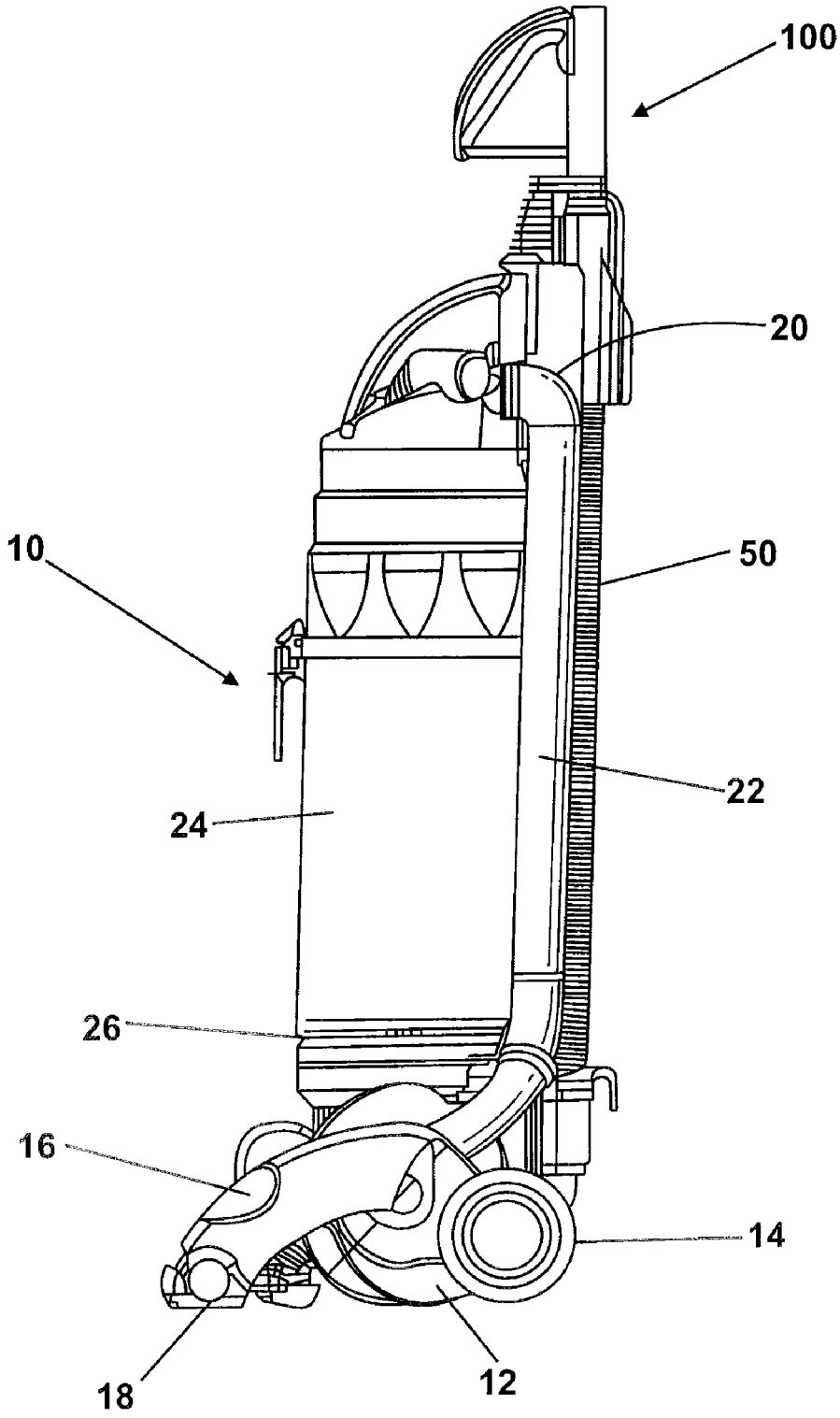
FIG. 1 shows an upright vacuum cleaner incorporating a handle assembly according to the invention and showing the handle assembly in a stored configuration.

A vacuum cleaner incorporating a handle assembly according to the invention is shown in FIG. 1. FIG. 1 shows an upright vacuum cleaner 10 having a main body 12 which includes a motor and fan unit (not shown) and a pair of wheels 14. A cleaner head 16 is pivotably mounted on the lower end of the main body 12 and a dirty air inlet 18 is provided in the underside of the cleaner head 16 facing the floor surface. The main body 12 further includes a spine 20 which extends upwards and includes ducting 22 for carrying an airflow.

Separating apparatus 24 is releasably held on the main body 12 adjacent the spine 20. In the embodiment shown, the separating apparatus 24 comprises a cyclonic separator but this could be replaced by a filter, a bag or a combination of different known separation devices. The nature of the separating apparatus 24 is not material to the present invention.

The interior of the separating apparatus 24 is in communication with the dirty air inlet 18 through the ducting 22 in the spine 20. Further, the separating apparatus 24 can be removed from the main body 12 for emptying purposes. The main body 12 also includes a plurality of outlet ports 26 for exhausting air from the vacuum cleaner 10. The outlet ports 26 are located below the separating apparatus 24. These features are not material to the present invention and will not be discussed further.

The vacuum cleaner 10 includes a hose 50 and a handle assembly 100. When attached to the vacuum cleaner 10 as shown in FIG. 1, a part of the handle assembly 100 extends inside the hose 50. The handle assembly 100 can be detached from the vacuum cleaner 10 and arranged so as to enable above-the-floor cleaning. These features will be discussed further later. The handle assembly 100 is shown in a stored configuration in FIG. 1. When the handle assembly 100 is in the stored configuration, the vacuum cleaner 10 is compact and easy to store.

Figure 2:
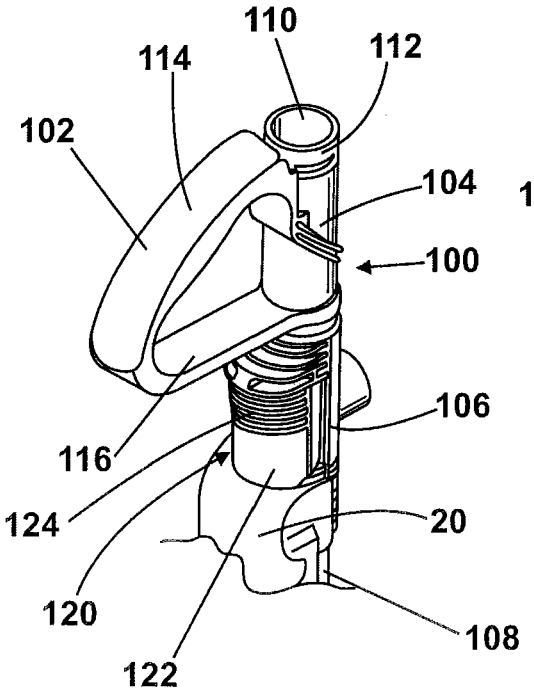
FIG. 2 is an isometric view of the handle assembly according to the invention showing the handle assembly in the stored configuration and attached to a part of the upright vacuum cleaner of FIG. 1.
Figure 3:
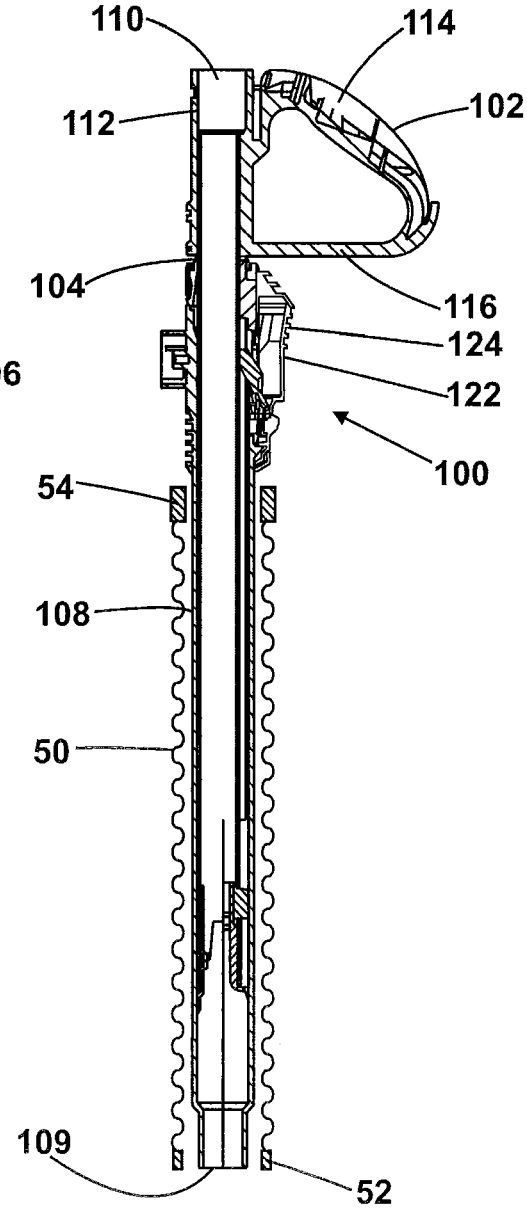
FIG. 3 is a side section of the handle assembly of FIG. 2 showing the handle assembly in the stored configuration.

The handle assembly 100 is shown in more detail in FIGS. 2 and 3. For clarity, FIG. 2 shows only the upper end of the handle assembly 100 and a part of the spine 20 of the vacuum cleaner 10. FIG. 3 shows the complete handle assembly 100 and hose 50 removed from the remainder of the vacuum cleaner 10. The handle assembly 100 is shown in the stored configuration in FIGS. 2 and 3.

The handle assembly 100 comprises a handle 102, a tubular wand 104, a connecting portion 106 and a fixed tube 108. The connecting portion 106 is adapted to connect to the spine 20 of the vacuum cleaner 10. The fixed tube 108 is attached to the connecting portion 106 and extends downwards from the connecting portion 106. The fixed tube 108 is hollow inside and has an opening 109 at the lower end.

Figure 4:
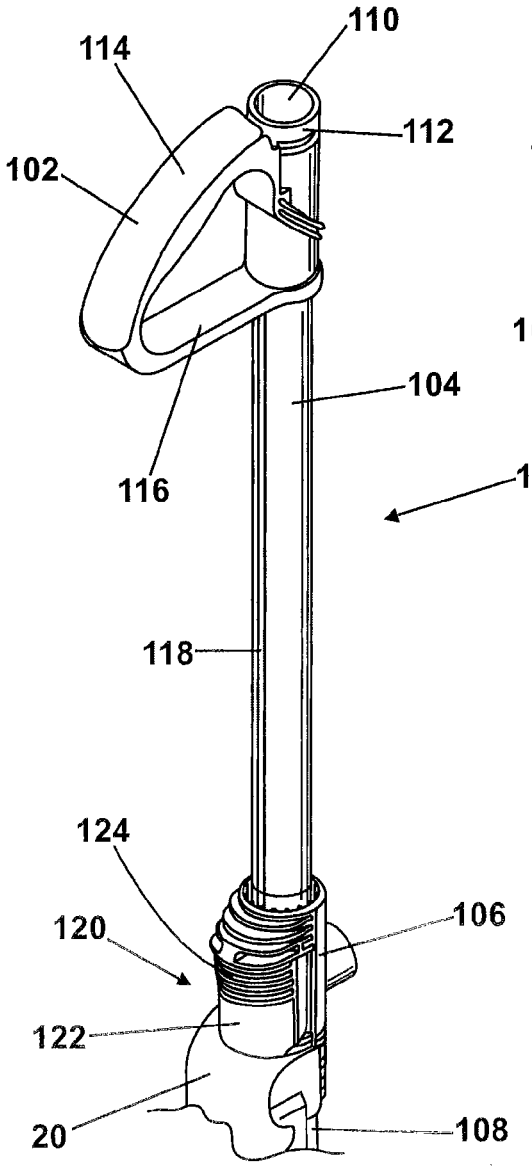
FIG. 4 is an isometric view of the handle assembly of FIG. 2 showing the handle assembly in an extended configuration.
Figure 5:
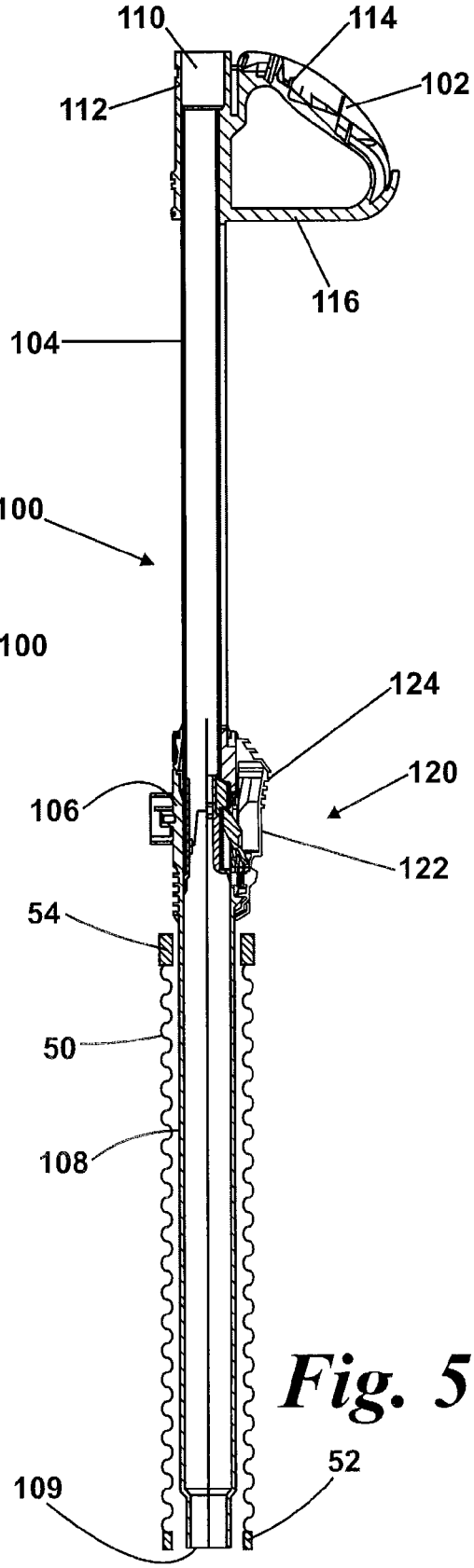
FIG. 5 is a side section of the handle assembly of FIG. 2 showing the handle assembly in the extended configuration.

The tubular wand 104 is able to slide with respect to the connecting portion 106 between a retracted position (as shown in FIGS. 2 and 3) and an extended position (as shown in FIGS. 4 and 5). The tubular wand 104 has a diameter which is smaller than that of the fixed tube 108 so that, when the tubular wand 104 is in the retracted position, a significant portion of the tubular wand 104 can be stored within the fixed tube 108. This is shown in FIG. 3. The tubular wand 104 and the fixed tube 108 lie coaxially with respect to one another, such that the tubular wand 104 is able to slide within the fixed tube 108.

The tubular wand 104 is open at its upper end 110. The open upper end 110 forms a connector 112 which is adapted to receive an end of the hose 50 when above-the-floor cleaning is required. A cover (not shown) may be provided over the upper end 110 to prevent ingress of dirt and dust into the tubular wand 104 and also to improve the appearance of the handle assembly 100.

The handle 102 is attached to the upper end 110 of the tubular wand 104 and moves with respect to the connecting portion 106 when the tubular wand 104 is slid between the retracted and extended positions. The handle 102 has a gripping portion 114 and a support member 116. The gripping portion 114 is arranged to be gripped by a user when manoeuvring the vacuum cleaner 10 across a floor surface or during above-the-floor cleaning. The support member 116 provides mechanical support for the gripping portion 114.

The hose 50 is secured to the main body 12 of the vacuum cleaner by a first connector 52 located at a first end of the hose 50. The first connector 52 is releasable so that the hose 50 can be removed for cleaning or replacement. However, other arrangements could be used; for example, a permanent connection to the main body 12 of the vacuum cleaner 10. The hose 50 also has a second connector 54 located at a second end of the hose 50. The second connector 54 is arranged to connect to the connector 112 when above-the-floor cleaning takes place.

Further, when the handle assembly 100 is stored on the vacuum cleaner 10, substantial portions of the tubular wand 104 and the fixed tube 108 lie inside the hose 50. This is shown in FIG. 3. The hose 50 sits around the outside of the fixed tube 108 but does not seal against it. By storing the tubular wand 104, the fixed tube 108 and the hose 50 coaxially with respect to one another, the handle assembly 100 is compact and easy to store.

In the configuration shown in FIGS. 1 and 2, no airflow is carried by the hose 50. This is because the vacuum cleaner 10 has a change-over valve (not shown) which selectively draws air in through the dirty air inlet 18 on the cleaner head 16 or through the hose 50. The change-over valve is operated by the lower end of the fixed tube 108. When the handle assembly 100 is stored on the vacuum cleaner 10 in the configuration shown in FIGS. 1 and 2, the fixed tube 108 engages with a part of the change-over valve in order to move the change-over valve into a position in which air is drawn in through the dirty air inlet 18.

When the tubular wand 104 is in the retracted position (as shown in FIGS. 2 and 3), the handle 102 lies directly above the connecting portion 106 and the tubular wand 104 is stored within the fixed tube 108. In this configuration, the vacuum cleaner 10 is compact and easy to store. However, in order for the user to use comfortably the vacuum cleaner 10 to clean a floor surface, the handle assembly 100 needs to be moved to an extended configuration.

The handle assembly 100 is shown in the extended configuration in FIGS. 4 and 5. FIG. 4 shows only the upper end of the handle assembly 100 and a part of the spine 20 of the vacuum cleaner 10. FIG. 5 shows the complete handle assembly 100 and hose 50 removed from the remainder of the vacuum cleaner 10 for clarity. In the extended configuration, the tubular wand 104 extends upwardly away from the connecting portion 106. In this configuration, the handle 102 is at a convenient height to be gripped by a standing user. Therefore, the vacuum cleaner 10 can be manoeuvred easily across a floor surface using the handle 102.

In order to facilitate the extension and retraction of the tubular wand 104 between the positions shown in FIGS. 3 and 5, the tubular wand 104 has a longitudinal groove 118 (this is best shown in FIG. 4) which cooperates with a complementary lug (not shown) located on the connecting portion 106. The longitudinal groove 118 and lug guide the tubular wand 104 along a linear path between the retracted and extended positions with respect to the connecting portion 106. Further, the longitudinal groove 118 and lug prevent the tubular wand 104 from rotating about the axis of movement with respect to the connecting portion 106.

The connecting portion 106 further includes a locking mechanism 120. The locking mechanism 120 is arranged to secure the handle assembly 100 to the spine 20 of the vacuum cleaner 10 as shown in FIGS. 1, 2 and 4. The locking mechanism 120 is also arranged to lock the tubular wand 104 in the extended position (as shown in FIGS. 4 and 5).

The locking mechanism 120 includes an actuator 122 which is pivotably mounted on the connecting portion 106. The actuator 122 is arranged to be pressed by a user to release the handle assembly 100 from the spine 20 and to unlock the tubular wand 104. The actuator 122 is located on a part of the connecting portion 106 which faces forwardly away from the user when the handle assembly 100 is connected to the vacuum cleaner 10. The makes the actuator 122 easily graspable by a user. The upper end of the actuator 122 has a plurality of parallel ribs 124 which define a user-operable button.

Figure 8:
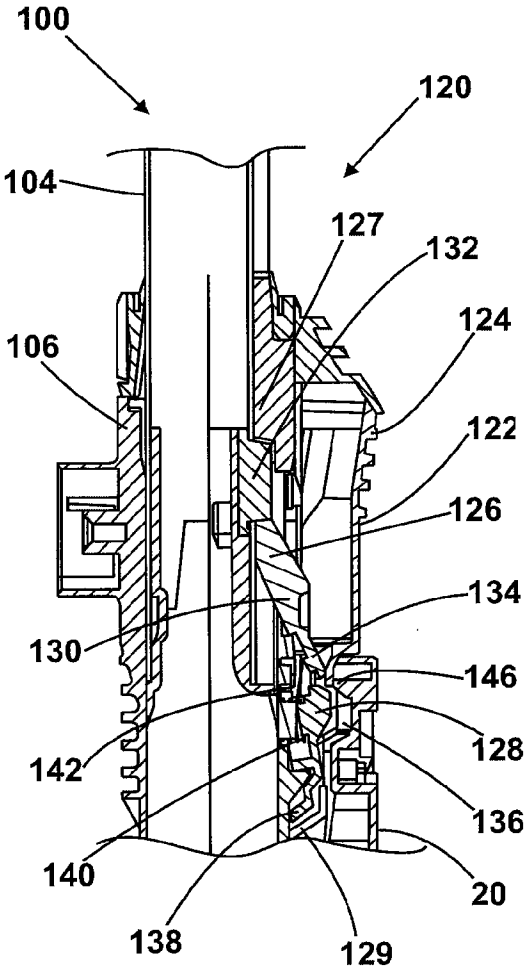
FIG. 8 is a view similar to FIG. 6 showing the locking mechanism in a third configuration.
Figure 7:
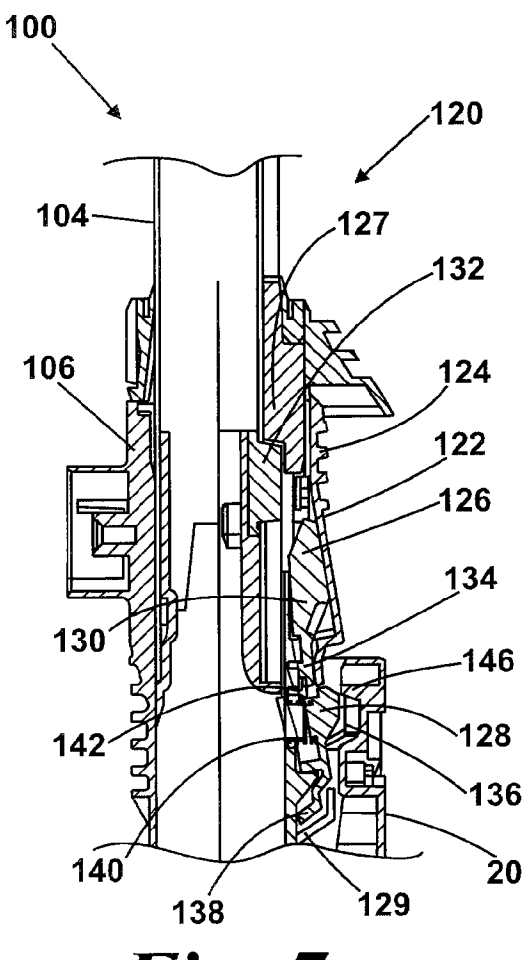
FIG. 7 is a view similar to FIG. 6 showing the locking mechanism in a second configuration.
Figure 6:
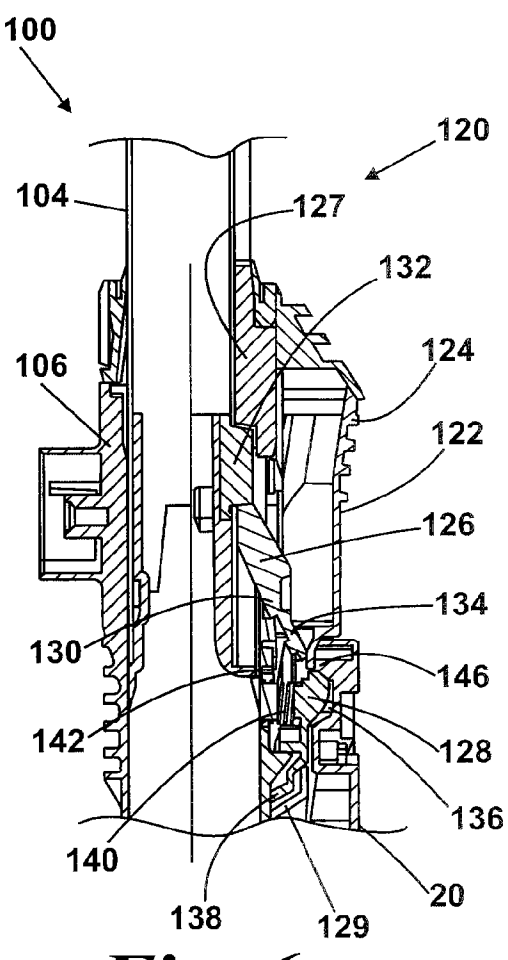
FIG. 6 is an enlarged side section of a part of the handle assembly of FIG. 2 showing the locking mechanism in a first configuration.

The locking mechanism 120 is shown in more detail in FIGS. 6 to 8. FIG. 6 shows the locking mechanism 120 in a first configuration. In the first configuration, the handle assembly 100 is attached to the spine 20 of the vacuum cleaner 10 and the tubular wand 104 is locked in the extended position. The locking mechanism 120 comprises the actuator 122, a wand catch 126 and a main body catch 128.

The actuator 122 is located on the connecting portion 106 and is pivotably attached to the connecting portion 106 about a pivot point 129. The actuator 122 is able to pivot about the pivot point 129 when pressed by a user in order to engage with the wand catch 126 and main body catch 128.

The wand catch 126 is pivotably connected to the connecting portion 106 about a pivot point 130. In FIG. 6, the wand catch 126 is shown in a first position in which the wand catch 126 engages a cooperating lug 132 located on the tubular wand 104. The wand catch 126 has a spring (not shown) which biases the wand catch 126 into the first position. When pressed, the actuator 122 engages with a lever 134 which is carried by the wand catch 126. This engagement pivots the wand catch 126 out of the first position to release the wand catch 126 from its engagement with the lug 132.

The tubular wand 104 is also prevented from moving upwardly by a shoulder 127 located towards the upper end of the connecting portion 106. When the wand catch 126 is in the first position, the tubular wand 104 is prevented from sliding with respect to the connecting portion 106 due to the interaction between the lug 132, the wand catch 126 and the shoulder 127. The engagement between these parts locks the tubular wand 104 in the extended position as shown in FIG. 5.

The main body catch 128 cooperates with a recess 136 located at the upper end of the spine 20 of the vacuum cleaner 10. The main body catch 128 is pivoted about a pivot point 138 and is movable independently of the actuator 122. A part of the main body catch 128 extends through an aperture formed in the actuator 122. This part of the main body catch 128 is received in the recess 136. In FIG. 6, the main body catch 128 is shown in a first position in which it is engaged with the recess 136. In the first position, the main body catch 128 secures the handle assembly 100 to the spine 20 of the vacuum cleaner 10. A spring 140 biases the main body catch 128 into the recess 136 as shown in FIG. 6. This prevents removal of the handle assembly 100 from the spine 20.

The main body catch 128 has a flange 142 which is larger than the aperture provided in the actuator 122. The flange 142 prevents the whole of the main body catch 128 from moving through the aperture under the bias of the spring 140. Therefore, the spring 140 pushes the main body catch 128 against the actuator 122. Consequently, when the actuator 122 is pressed inwardly, the main body catch 128 moves inwardly with the actuator 122.

FIG. 7 shows the locking mechanism 120 in a second configuration. In the second configuration, the actuator 122 has been pivoted into an inward position about the pivot point 144. In traveling to this position from the position shown in FIG. 6, the actuator 122 engages with the lever 134 of the wand catch 126. This moves the wand catch 126 about the pivot point 130 and into a second position in which the wand catch 126 is spaced from the cooperating lug 132 as shown in FIG. 7.

Due to the engagement between the flange 142 and the actuator 122, the main body catch 128 is also moved inwardly with the actuator 122 into a second position in which the main body catch 128 is spaced from the recess 136. Therefore, in the second configuration of the locking mechanism 120, the wand catch 126 and the main body catch 128 are both in second, or unlocked, positions. Consequently, the handle assembly 100 can be removed from the vacuum cleaner 10 for above-the-floor cleaning if desired. Further, the tubular wand 104 is unlocked from the extended position and is free to move within the connecting portion 106.

FIG. 8 shows the locking mechanism 120 in a third configuration. The third configuration arises when a user changes the mode of operation of the vacuum cleaner 10 from above-the floor cleaning to floor cleaning. In this configuration, the actuator 122 is in the outward position (as in the first configuration) and the wand catch 126 is in the first position because it is biased thereto by the spring. Therefore, the tubular wand 104 will remain locked in the extended position.

However, as the handle assembly 100 is reattached to the main body 12 of the vacuum cleaner, the main body catch 128 engages with a projection 146 located at the upper end of the spine 20 of the vacuum cleaner 10 above the recess 136. Since the main body catch 128 is movable independently of the actuator 122, the main body catch 128 is able to move inwardly against the bias of the spring 142 without displacing the actuator 122. This is shown in FIG. 8. When the main body catch 128 becomes aligned with the recess 136, the main body catch 128 is able to move back into the first position under the bias of the spring 142. Therefore, the handle assembly 100 can be releasably secured to the main body 12 of the vacuum cleaner 10 without unlocking the wand catch 126 and thus without unlocking the tubular wand 104 from the extended position.

The above-described arrangement is particularly suited to a small vacuum cleaner where the available space is limited. The advantage of the above arrangement is that it enables both the wand catch and the main body catch to be located close to one another. This allows the locking mechanism to be more compact.

The arrangement described above is particularly suited to a small upright vacuum cleaner, commonly known as a stick-vacuum. Stick-vacuums are generally much smaller in size than conventional upright vacuum cleaners. Therefore, they tend to be less powerful and comprise fewer features. However, the above arrangement allows the wand and main body catches to be small yet to have excellent functionality. By providing a main body catch which is separately movable with respect to the actuator, there is no need for two actuators to be provided, or for a single actuator to have two separate stages of travel. Consequently, the above arrangement reduces the size of the actuator and locking mechanism, which in turn allows the size of the vacuum cleaner to be reduced.

In use, the user starts with the vacuum cleaner 10 in the configuration shown in FIG. 1. In this configuration, the handle assembly 100 is in the stored configuration; the handle assembly 100 is secured to the main body 12 of the vacuum cleaner 10 and the tubular wand 104 is in the retracted position. In order to configure the vacuum cleaner 10 for cleaning a floor surface, the user extends the tubular wand 104 by pulling upwardly on the handle 102 until the tubular wand 104 is locked in the extended position shown in FIG. 4. The locking mechanism 120 is now in the first configuration as shown in FIG. 6.

The user then switches the vacuum cleaner 10 on so that the motor and fan unit draws dirty air into the vacuum cleaner 10 via the dirty air inlet 18. The user manipulates the handle 102 to manoeuvre the vacuum cleaner 10 across the floor surface in order to carry out a cleaning operation. The dirty air, carrying dirt and dust from the floor surface, is drawn into the separating apparatus 24 via the ducting 22 in the spine 20. Dirt and dust is separated from the airflow by the separating apparatus 24 and retained therein. The cleaned air then passes from the separating apparatus 24, through a pre-motor filter (not shown), across the motor for cooling and through a post-motor filter (not shown) before being ejected from the vacuum cleaner 10 via the outlet ports 26.

The user may also wish to clean surfaces above the floor. In order to do this the user depresses the actuator 122. This moves the locking mechanism 120 into the second position as shown in FIG. 7. The handle assembly 100 can then be removed from the main body 12 of the vacuum cleaner 10 because the main body catch 128 vacates the recess 136. As the user removes the handle assembly 100 from the main body 12, the fixed tube 108 will slide out of the hose 50. When the fixed tube 108 is removed from the stored position shown in FIGS. 2 and 3, the change-over valve switches the airflow path to draw air in through the hose 50 instead of the dirty air inlet 18.

Figure 9:
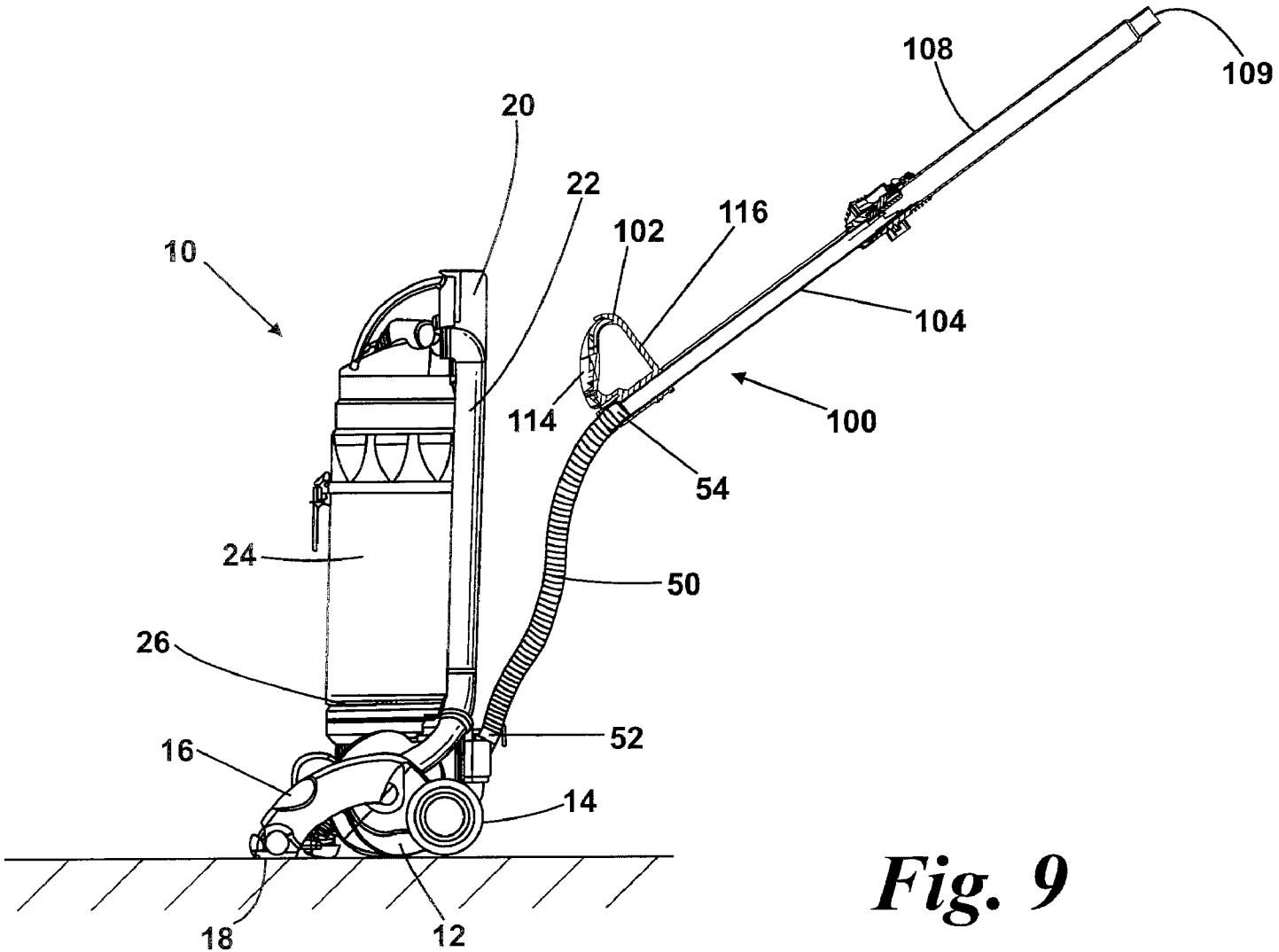
FIG. 9 is a side view of the vacuum cleaner of FIG. 1 showing the handle assembly released from the vacuum cleaner and configured for above-the-floor cleaning.

Once the handle assembly 100 is released from the main body 12 of the vacuum cleaner 10 and the hose 50, the user turns the handle assembly 100 around and attaches the second connector 54 of the hose 50 to the connector 116 adjacent the handle 102. The second connector 54 attaches to the connector 116 by way of a catch (not shown) although other arrangements, such as a friction fit or a snap fit, may alternatively be used. The vacuum cleaner 10 is now configured for above-the-floor cleaning. This configuration is shown in FIG. 9. The user then grips the gripping portion 114 of the handle 102 and manipulates the handle assembly 100 to clean, for example, walls, doors or ceilings. Optionally, an accessory tool such as a stair tool or a crevice tool may be attached to the distal end of the fixed pipe 108.

When the user has finished the above-the-floor cleaning operation, the user may wish to return the vacuum cleaner 10 to the floor cleaning mode. In order to do this, the user disconnects the second connector 54 from the connector 116, turns the handle assembly 100 around and reinserts the fixed tube 108 back into the end of the hose 50. The user also aligns the connecting portion 106 with the spine 20 of the vacuum cleaner 10 in order to reattach the handle assembly 100 to the main body 12 of the vacuum cleaner 10 without depressing the actuator 122.

When the connecting portion 106 is re-connected to the spine 20, the main body catch 128 abuts the projection 146 above the recess 136. The main body catch 128 therefore moves inwardly against the bias of the spring 142 into the second position. However, the actuator 122 is not displaced by the projection 146 and so the wand catch 126 remains in the first position. The locking mechanism 120 is now in the third configuration as shown in FIG. 8.

When the main body catch 128 enters the recess 136, the main body catch 128 moves back into the first position under the bias of the spring 142. The handle assembly 100 is now releasably secured to the main body 12 of the vacuum cleaner 10 whilst the tubular wand 104 remains locked in the extended position. The replacement of the handle assembly 100 on the vacuum cleaner 10 operates the change-over valve which switches the airflow path back to draw air in through the dirty air inlet 18. The vacuum cleaner 10 is now reconfigured for floor cleaning without the user having to be concerned about returning the tubular wand 104 to the extended position. The tubular wand 104 is also prevented from collapsing unexpectedly which may cause injury or be frustrating.

When the user has finished the cleaning operation, the vacuum cleaner 10 is switched off. In order to return the vacuum cleaner 10 to a storage configuration as shown in FIG. 1, the user depresses the actuator 122. This action unlocks the tubular wand 104 and allows the tubular wand 104 to be collapsed from the extended position into the retracted position for storage. This action also disengages the main body catch 128 from the recess 136 but the geometry of the connecting portion 106 ensures that the handle assembly 100 will not fall away from the vacuum cleaner 10 unless the user desires to remove the handle assembly 100. The vacuum cleaner 10 is now back in the configuration shown in FIG. 1.

The invention is not limited to the detailed description given above. Variations will be apparent to the person skilled in the art. For example, other forms and arrangements of the wand catch and main body catch may be used; for instance, electronic or magnetic catches.

If mechanical catches are used, arrangements other than pivotable catches may be used; for example, sliding catches or deformable catches.

Alternative forms of actuator may be used. The actuator need not be pivotable nor need it comprise a user operable button. The actuator may be electronically operated or may comprise sliding or deformable components. What is important is that an actuator is able to operate both the wand catch and the main body catch, but the main body catch is operable independently of the actuator. In other words, the main body catch is moveable separately from the actuator.

The handle need not be attached to one end of the tubular wand. Whilst this is preferred, the handle may be attached to the connecting portion of the handle arrangement and not movable with the tubular wand. There also need not be a fixed tube. Instead, a tubular wand may move with respect to a handle portion located on the connecting portion between extended and retracted positions.

Additionally, the tubular wand may have more positions than merely retracted and extended. Notches may be provided in the longitudinal groove to allow the wand to be locked in a number of different positions of extension. What is important is that the tubular wand is slideably extendible and has a stored position and at least one extended position in which the tubular wand can be locked.

The cleaning appliance need not be an upright vacuum cleaner. The invention is applicable to other types of vacuum cleaner, for example, stick-vacuums. Further, the present invention is applicable to other types of cleaning appliances, for example, a wet and dry machine or a carpet shampooer.

The invention claimed is:

1. A handle assembly for a cleaning appliance, comprising, a slideably extendible wand and a connecting portion, the connecting portion comprising a first locking arrangement releasably securing the handle assembly to a main body of the cleaning appliance, a second locking arrangement releasably locking the wand in a pre-determined position with respect to the connecting portion and an actuator, the actuator being configured to move the first and second locking arrangements between locked and unlocked positions, and wherein the first locking arrangement is also movable independently of the actuator.

2. The handle assembly of claim 1, wherein the first locking arrangement is movable independently of the actuator by engagement with the main body of the cleaning appliance.

3. The handle assembly of claim 1 or 2, wherein the wand is slideable between retracted and extended positions with respect to the connecting portion.

4. The handle assembly of claim 3, wherein the pre-determined position is the extended position.

5. The handle assembly of claim 1 or 2, wherein a handle is attached to one end of the wand and is movable with respect to the connecting portion.

6. The handle assembly of claim 1 or 2, wherein the first locking arrangement comprises a pivotable catch arranged to engage with a recess formed in the main body of the cleaning appliance.

7. The handle assembly of claim 6, wherein the pivotable catch has a flange configured to engage with the actuator to enable movement therewith.

8. The handle assembly of claim 6, wherein the pivotable catch extends through an aperture formed in the actuator.

9. The handle assembly of claim 1 or 2, wherein the second locking arrangement comprises a pivotable catch arranged to engage with a projection formed on the wand.

10. The handle assembly of claim 9, wherein the pivotable catch carries a lever which engages with the actuator.

11. The handle assembly of claim 1 or 2, wherein the actuator is pivotable.

12. The handle assembly of claim 1 or 2, wherein the actuator includes a user operable button.

13. The handle assembly of claim 1 or 2, wherein the connecting portion carries a fixed tube and the wand is adapted and arranged to slide with respect to the fixed tube.

14. The handle assembly of claim 13, wherein the wand slides inside the fixed tube.

15. The handle assembly of claim 1 or 2, wherein the handle assembly further comprises a connector located adjacent the handle and which is configured to connect to an end of a flexible hose, the other end of the flexible hose being arranged to connect to the cleaning appliance.

16. The handle assembly of claim 15, wherein at least a part of the wand is arranged to be stored within the hose when the handle assembly is releasably secured to the main body of the cleaning appliance.

17. A vacuum cleaner comprising the handle assembly of claim 1 or 2.

* * * * *

UNITED STATES PATENT AND TRADEMARK OFFICE

CERTIFICATE OF CORRECTION

PATENT NO. : 8,108,967 B2
APPLICATION NO. : 12/185635
DATED : February 7, 2012
INVENTOR(S) : Ralph Michael Wood It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 729 days.

Signed and Sealed this
Seventeenth Day of April, 2012

David J. Kappos

David J. Kappos
*Director of the United States Patent and Trademark Office*